United States Patent [19]

Watanabe

[11] Patent Number: 4,538,844

[45] Date of Patent: Sep. 3, 1985

[54] LOCKING DEVICE FOR DOOR

[75] Inventor: Minoru Watanabe, Kokubunji, Japan

[73] Assignee: Kabushiki Kaisha Murakoshi Seiko, Tokyo, Japan

[21] Appl. No.: 574,735

[22] Filed: Jan. 30, 1984

[30] Foreign Application Priority Data

Jul. 14, 1983 [JP] Japan ..... 58-109559[U]

[51] Int. Cl.[3] ..... E05C 9/08

[52] U.S. Cl. ..... 292/127; 292/DIG. 4; 292/DIG. 37

[58] Field of Search ..... 292/119, 127, 221, 214, 292/227, 218, DIG. 4, DIG. 37

[56] References Cited

U.S. PATENT DOCUMENTS 1,462,637 7/1923 Fetner ..... 292/227

1,954,500 4/1934 Sparks ..... 292/227 X 3,844,591 10/1974 Velcover ..... 292/218 X 3,992,052 11/1976 Green ..... 292/119 X 4,482,175 11/1984 Sugie ..... 292/DIG. 4

*Primary Examiner*—Richard E. Moore

*Attorney, Agent, or Firm*—James E. Nilles

[57] ABSTRACT

A device to lock a door body provided on a main body, wherein by a sliding body provided slidably on a framework attached to the inside of the door body and having such an operational mechanism as to be pushed within the framework by first pushing and to be protruded forwards by second pushing, a hook body provided turnably within the framework is protruded out of a window hole provided at one side of the framework so as to be engaged with and disengaged from the main body side. The sliding body has a knob at its outside.

4 Claims, 9 Drawing Figures

LOCKING DEVICE FOR DOOR

BACKGROUND OF THE INVENTION

1. Field of the Invention

The present invention relates to a locking device for a door for a wardrobe or the like.

2. Description of the Prior Art

Various types of locking devices for wardrobes and the like have been used hitherto, but in every such device having an interior hook actuated to locking and unlocking positions by a customary handle, the device was comparatively large, and its operational mechanism was complex, making it troublesome and not suitable to be made at low cost.

SUMMARY OF THE INVENTION

The object of the present invention is to avoid these disadvantages. The invention is intended to provide simple and compact operational mechanism that operates easily and can be made at low cost.

The door locking device of the present invention is characterized by comprising, in a locking device to lock a door, a housing attached to an inside surface of the door near a free end thereof and having a latch aperture in its one side adjacent to said edge of the door; a latch hook pivoted in the housing to swing between a latching position protruding from the housing through said aperture and a retracted position substantially wholly within the housing; a crank arm constrained to swing in unison with said latch hook and having a crank slot; a sliding body confined to forward and rearward sliding in said housing and yieldingly biased forwardly, said sliding body having a pin fixed thereon which is slidably engaged in said crank slot and which cooperates with the crank arm to translate rearward and forward movement of the sliding body into movement of the latch hook respectively towards its latching position and towards its retracted position, and said sliding body further having a substantially heart-shaped cam groove; and an operating rod substantialy confined against forward and rearward motion relative to the housing and having a portion engaged in said cam groove to so cooperate therewith that successive rearward actuations of said sliding body alternately establish it in a rearward locking position in which it holds the latch hook in its latching position and in a forward unlocking position in which it holds the latch hook in its retracted position.

Other objects and characteristics of the present invention will be explained by referring to the drawings.

BRIEF DESCRIPTION OF THE DRAWINGS

The drawings show a preferred embodiment of the present invention, wherein.

DESCRIPTION OF THE PREFERRED EMBODIMENT

Figure 1:
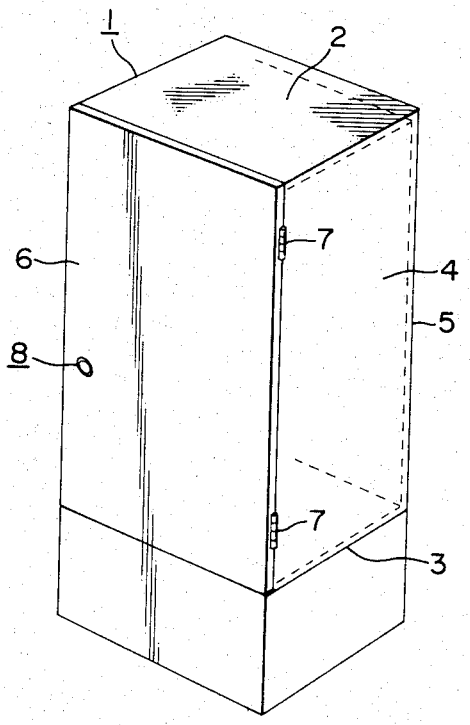
FIG. 1 is a perspective view of a wardrobe.
Figure 3:
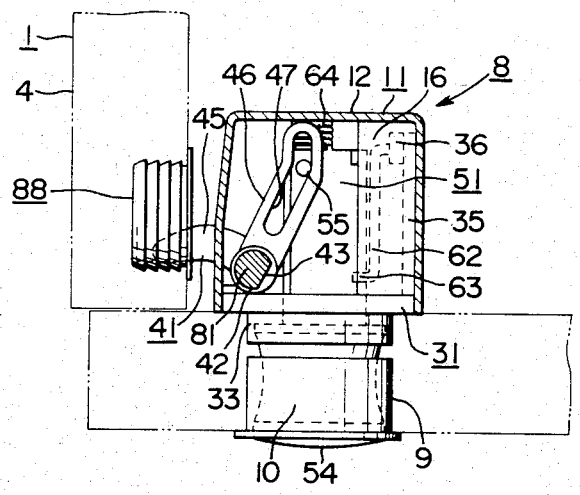
FIG. 3 is a sectional view along line III—III in FIG. 2.

In FIG. 1, a box-shaped main body (1) opened at the front thereof comprises top wall (2), base wall (3), side walls (4) at both sides thereof and a rear wall (5).

A door (6) is attached so as to be opened and closed freely by multiple hinges (7) at one of its edges, and a locking device (8) is provided adjacent to one of the free edges of the door, in this case its edge opposite the hinged one.

Figure 2:
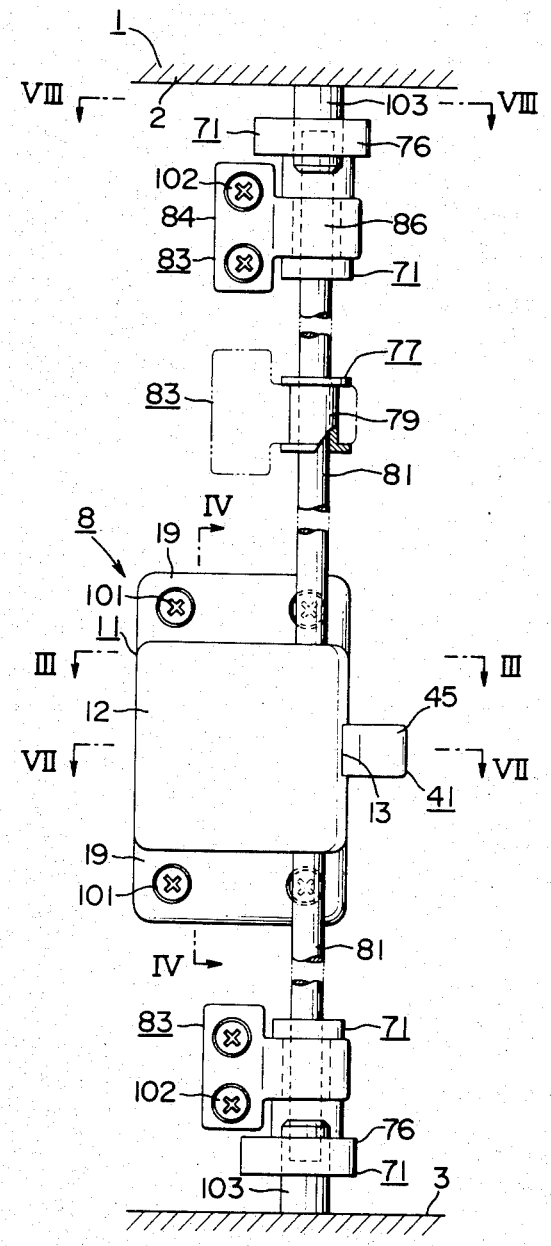
FIG. 2 is a front view of the locking device partially cut away.
Figure 4:
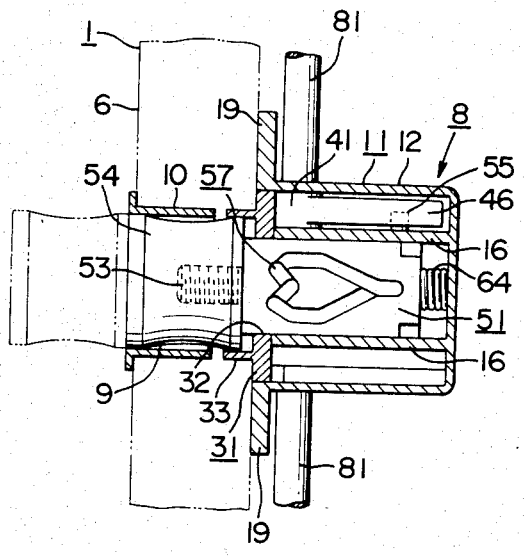
FIG. 4 is a sectional view along line IV—IV in FIG. 2.
Figure 5:
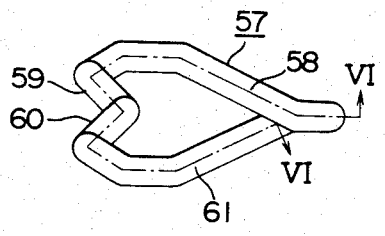
FIG. 5 is a plan view of the cam groove in the sliding body.
Figure 6:
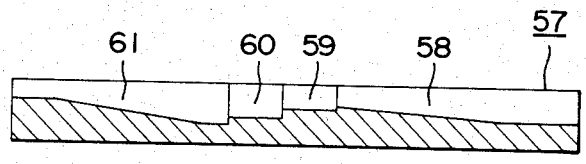
FIG. 6 is a sectional view along line VI—VI in FIG. 5.
Figure 7:
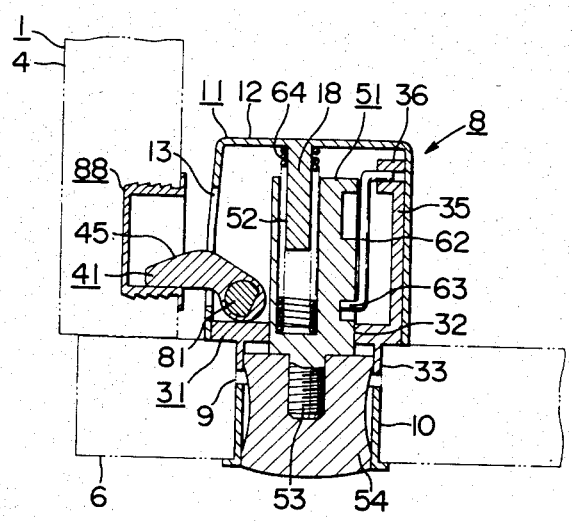
FIG. 7 is a sectional view along line VII—VII in FIG. 2.
Figure 8:
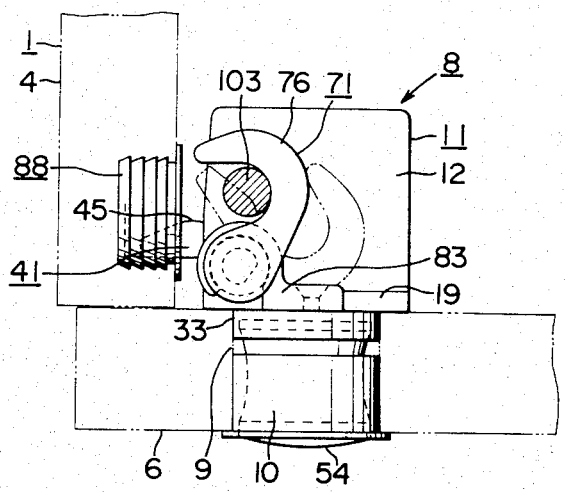
FIG. 8 is a sectional view along line VIII—VIII in FIG. 2.
Figure 9:
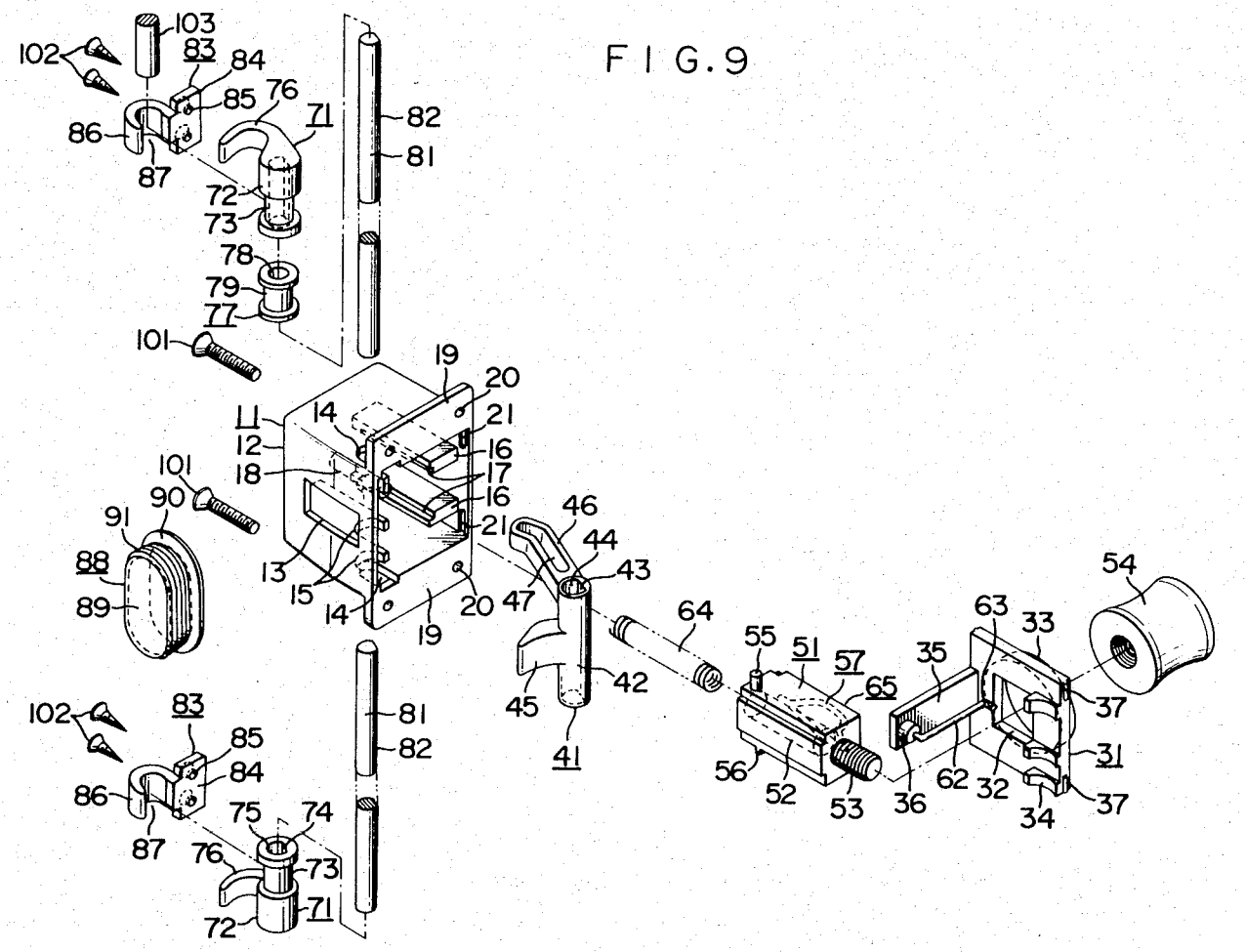
FIG. 9 is an exploded perspective view of the locking device.

This locking device (8) will be explained with reference to FIG. 2 and the following figures.

In the figures, a synthetic resin housing (11) having flat walls (12) is open at its front and has a latch aperture (13) in its side wall nearest its adjacent edge of the door (6). Through-holes (14) are formed in the upper and lower walls of the housing (11), and bearing parts (15) of semi-circular arc-shape are formed at the inside of the housing in line with the upper and lower through-holes (14). A pair of sliding-guide plates (16) are formed within the housing (11) at its side opposite the latch aperature (13), having inner edge portions that define fore-and-aft extending guide rails (17). And, a support (18) protrudes toward the open side from the center of the inner bottom part within the housing (11). Further, flanges (19) project up and down from the respective upper and lower parts of the open side of the housing (11) and a plurality of attaching holes (20) are bored in these flanges (19). Further, a plurality of engaging recesses (21) for a cover body are formed on the inner face at both sides of the open side of the housing (11).

A synthetic resin cover (31) is attached to the open front side of the housing (11). A square-shaped, through-hole (32) is formed in this cover body (31), and an annular forwardly protruding wall (33) is provided on the outer face of the cover body (31) surrounding the through-hole (32). Semi-circular arc shaped bearing parts (43) are formed at one side of the inner face of the cover body (31), each opposed to a bearing part (15) of the housing (11), and a support piece (35) positioned between the pair of sliding-guide plates (16), protrudes rearward from the other side of the cover body (31). An operating rod supporting part (36) is provided at the tip end part of this support part (36). Further, engaging projections (37), each corresponding to an engaging recess (21) of the housing (11), protrude from both end faces of the cover body (31). Thus the cover body (31) is fitted and fixed to the open side of the housing (11) by engaging each engaging projection (37) in the engaging recess (21) of the housing, and the support piece (35) is inserted between base parts of one pair of sliding-guide plates (16), and the bearing parts (15), (34) are positioned in opposed relation.

A latch hook body (41) is made of metal and received within the housing (11), and this latch hook body (41) has a cylindrical shaft part (42) corresponding to the bearing parts (15), (34) of the housing (11) and cover body (31). An inserting hole (44) that has a flat (43) along one side is formed within this shaft part (42). A latch hook (45) protrudes from the intermediate part of the shaft part (42), projecting to one side of it, and a crank arm (46) protrudes from the upper end of the shaft part (42), projecting laterally from it in a direction substantially perpendicular to that of the hook (45). The tip end part of this crank arm (46) is bent slightly toward the hook (45), and a crank-slot (47) is formed along the center line of the crank arm (46). Further, the shaft part (42) of the hook body (41) is rotatably supported by the bearing parts (15), (34) of the housing (11) and the cover body (31), and the latch hook (45) thus swings to and from a latching position in which it protrudes out of the latch aperture (13) of the housing (11).

A square-pillar shaped sliding body (51) is formed from synthetic resin to be inserted within the housing (11), and it has a thread part (53) that protrudes forward from its front end to project out of the housing (11) and through the through-hole (32) of the cover body (31). A knob (54) positioned within the annular wall (33) of the cover body (31) is screwed to this threaded part (53). Further, a crank pin (55) inserted slidably into the crank-slot (47) of the crank arm (46) protrudes at a corner on the upper face of the sliding body (51), near its rear end, and a stopper (56) that cooperates with the rear or inner face of the cover body (31) protrudes from the lower face of the sliding body (51).

A substantially heart-shaped cam groove (57) is provided in the side face of the sliding body (51) that faces the support piece (35) on the cover body (31). This cam groove (57) comprises a first guide groove (58) which becomes gradually shallower in depth towards the front end of the sliding body (51), a second guide groove (59) which is connected with the forward end of the first guide groove (58) and is slightly deeper than the depth at the front end of the first guide groove (58), a third guide groove (60) which is connected with the second guide groove (59) and is slightly deeper than the depth of the second guide groove (59), and a fourth guide groove (61) which extends rearwards from the front end of the third guide groove (60). At its rear end the fourth guide groove (61) is connected with the first guide groove (58) a short distance forward of the rear end of the latter; and its depth at its front end is slightly greater than the depth of the guide groove (60) but it becomes progressively shallower from there and its depth at its rear end is slightly less than the depth of the guide groove (58) where it joins the latter. A base part of an operating rod (62) made of metal is rotatably supported on the supporting part (36) for the operating rod (62) on the support piece (35) of the cover body (31), and a follower part (63) at the tip end of the operating rod (62) is slidably received in the cam groove (57). This follower part (63) is urged toward the bottom of the cam groove (57) by spring force of the operating rod (62), and the follower part (63) slides successively from the shallower groove to the deeper groove within each guide groove (58), (59), (60), (61) as the sliding body (51) slides forward and rearward in the housing (11). The sliding body (51) is fitted slidably between the guide parts (17) of the pair of slide guide plates (16) and between the bearing parts (15) within the housing (11), and its front or outer end protrudes out of the cover body (31) through its through-hole (32). A coil spring (64) fitted to the support (18) in the housing is inserted into a spring receiving hole (52) in the sliding body (51) that opens to the rear end thereof. The spring (64) maintains a forward bias on the sliding body (51). An operating mechanism (65) for the sliding body (51) is thus formed by the cam groove (57), the operating rod (62) and the spring (64).

Thus, the cover body (31), latch hook body (41) and sliding body (51) are received in the housing (11), which is arranged on the inner face of the door (6), and the knob (54) attached to the sliding body (51) is received within a hole (9) formed in the door-body (6). Further, a cylindrical cap-body (10) receives the knob (54) is fitted into the hole (9).

Upper and lower hook bodies (71) of synthetic resin each have a cylindrical shaft part (72) which has a medial part (73) of reduced diameter. The cylindrical shaft part (72) is further provided with an inserting hole (75) having flat (74) along one side, corresponding to inserting hole (44) of said latch hook body (41). A hook (76) protrudes laterally from at the end of the shaft part (72).

There is provided an intermediate bearing (77) of synthetic resin, and an inserting hole (78) is formed at the center of this intermediate bearing (77). The medial portion (79) of this bearing has a reduced outside diameter.

Upper and lower connecting shafts (81) of metal each have a flat side (82) corresponding to the flats (43), (74) of the inserting hole (44) of the latch hook body (41) and the inserting holes (75) of the upper and lower hook bodies (71).

The connecting shafts (81) are inserted into the inserting hole (44) of the latch hook body (41) and, extending through the througholes (14) in the housing (11), are received in the inserting holes (75) in the upper and lower hook bodies (71). The flats (82) on the connecting shafts (81) cooperate with the flat surfaces (43) and (74) in the hook bodies (41) and (71) to constrain those hook bodies to swing in unison about the coinciding axes of the shafts (81).

Further, at least one of the intermediate bearings (77) is fitted onto each connecting shaft (81), which extends through its inserting hole (78), between the housing (11) and the upper and lower hook bodies (71), when it is necessary.

For each of the upper and lower hook bodies (71) there is a bearing body (83) of synthetic resin, housing a base plate (84) in which there are attaching holes (85). A circular arc-shaped support part (86) corresponding to the inserting part (73) of the hook body (71) protrudes from one side of the base plate (84) and has therein an inserting opening (87) of smaller diameter than the inserting part (73) is of the hook body (71).

A keeper (88) of synthetic resin cooperates with the latch hook (45). The keeper (88) has a cup shaped body (89) which is provided with a flange (90) around its open end and which has circumferentially extending corrugations or serrations (91) on its periphery.

The housing (11) is attached onto the inner face of the door (6) by screws (101) through the attaching holes (20) of its flanges (19) as described above, and the knob (54) is arranged within the hole (9) in the door (6). The cooperating shaft (81) extends in the vertical direction. The bearing body (83) is arranged at the upper and lower parts of the door body (6), fixed by screws (102) through the attaching holes (85) in its base plate (84). The fitting parts (73) of the upper and lower hook bodies (71) are fitted into the resilient support part (86) of each bearing body (83) by being snapped into its inserting opening (87). Thus, the upper and lower hook bodies (71) are supported at prescribed positions. Further, when the intermediate bearing (77) is used, a bearing body (83) is attached also at its position, and the support part (86) is fitted into its fitting part (79).

Further, in the inner face part of the side wall (4) at said one side, the keeper (88) is arranged in a position to receive the latch hook (45), the keeper body (89) being secured by the engagement of its corrugations (91).

Further, there is a lock pin (103) for each of the upper and lower hook bodies (71), and those lock pins (103) respectively project from the lower face of the top wall 2 and the upper face of the bottom wall (3).

Next, operation of the device will be explained.

When the door body (6) is open relative to the main body (1), the knob (54) projects forward beyond the front face of the door (6) through the hole (9) in the door (6), and at the same time, the sliding body (51) is also projects partway out of the housing (11), urged by the coil spring (64) to have its front portion extend through the through-hole (32) in the cover body (31) and into the hole (9) in the door (6). At this time, the engaging part (63) of the operating rod (62) is positioned within the rear end part of the first guide groove 58 at the rear end of the heart-shaped cam groove (57). When the knob (54) is pushed in by the finger against the biasing force of the coil spring (64), the sliding body (51) is pushed rearward into the housing (11) by sliding, and at the same time, the follower part (63) of the operating rod (62) falls into the second guide groove (59). As the finger is released here, the follower part (63) slides up to the third guide groove (60) from the second guide groove (59) since the sliding body (51) is pushed forward relative to the door (6) by the coil spring (64). The rear end of the second guide groove (59) thus cooperates with the follower part (63) and the spring (64) to maintain the sliding body (51) in a locking position in which it is just sightly forward of its rear limit of sliding motion. As the knob (54) is pushed by the finger again, the follower part (63) of the operating rod (62) enters the fourth guide groove (61) from the third guide groove (60), and as the finger is released here, the sliding body (51) sides forward relative to the door (6) and is partway out of the housing (11) to a forward unlocking position. At the same time, the follower part (63) of the operating rod (62) moves into the first guide groove (58) from the fourth guide groove (61) and is engaged within the rear end part of the first guide groove (58), that is, within the protruding end of the heart shaped groove.

As the sliding body (51) slides into and partway out of the housing (11), the crank pin (55) on the sliding body (51) swings the latch hook body (41) through the crank arm (46). When the sliding body (51) is in its forward position in the door (6) the latch hook (45) of the hook body (41) is retracted through the latch aperture (13) of the housing (11), so that its engagement with the keeper (88) is released. As the sliding-body (51) is pushed rearward into the housing (11), the latch hook (45) of the hook body (41) is swung to project out of the latch aperture (13) and is engaged with the keeper (88) whereby it assumes its locking state.

Further, with turning of the latch hook body (41), the upper and lower hook bodies (71) are turned through the upper and lower cooperating shafts (81) to be engaged or disengaged, as the case may be, from the lock pins (103).

According to the present invention, when the sliding body is moved by pushing on the knob 54 at the hook bodies are turned by cooperation of the crank arm with the crank pin in the crank-slot, to thereby operate the hooks. At the same time the upper and lower hook bodies are operated through the cooperating shaft. Thus the construction of the device is simple and it can be arranged to be. It can be made at a low price, and further its operation is extremely easy since the hook bodies may be turned by merely pushing the sliding body.

What is claimed is:

1. A locking device for a door which has front and rear surfaces, a hinged edge and free edges and which is hinged to a frame at its hinged edge to swing forward to an open position and rearward to a closed position, said locking device comprising:

A. a housing for securement to the rear surface of the door near one of its free edges, said housing
  (1) having top, bottom, rear and side walls,
  (2) having an open front that can align with a hole through the door, and
  (3) having a latch hook aperture in its side wall nearest said free edge of the door;

B. a latch hook body in said housing having
  (1) a shaft portion which has its axis substantially parallel to the side and rear walls of the housing and which is confined to rotation about its axis relative to the housing,
  (2) a latch hook projecting laterally from said shaft portion to be swung by rotation of the shaft portion between a retracted position, disposed substantially wholly within the housing, and a latching position protruding from said housing through said aperture for engagement with a keeper on said frame, and
  (3) a crank arm secured to said shaft portion and projecting laterally therefrom in axially spaced relation to said latch hook, said crank arm having a crank slot therein;

C. a sliding body confined by said housing to forward and rearward sliding motion therein and biased forwardly, said sliding body
  (1) having a pin fixed thereto which is slidingly engaged in said crank slot and which cooperates with the crank arm to translate forward and rearward motion of the sliding body into rotation of said shaft portion that swings the latch hook respectively to its locking position and to its releasing position, and
  (2) having a substantially heart-shaped cam groove therein;

D. means on the front of said sliding body, projecting through said hole through the door, for manually actuating the sliding body rearward against its bias; and E. an operating rod substantially confined against forward and rearward motion relative to the housing and having a portion engaged in said cam groove to so cooperate therewith that successive rearward actuations of the sliding body alternately establish it in a rearward position in which it maintains said latch hook in its retracted position and in a forward position in which it maintains the latch hook in its latching position.

2. The locking device of claim 1, further characterized by: said sliding body being biased forwardly by a coiled spring received in a forwardly opening well in its front end and reacting between the sliding body and the rear wall of said housing.

3. The locking device of claim 1, further characterized by: said heart-shaped cam groove being defined by
  (1) a first guide groove which becomes gradually shallower in depth towards the front end of the sliding body, (2) a second guide groove which extends obliquely laterally and rearwardly from the front end of the first guide groove and which is deeper than the front end portion of the first guide groove, (3) a third guide groove which extends obliquely laterally and forwardly from the rear end of the second guide groove and which is deeper than the latter, and (4) a fourth guide groove which extends rearwardly from the front end of the third guide groove and is connected at its rear end with the first guide groove, near the rear end of the latter, the front end of said fourth guide groove being shallower than the first guide groove at the junction of the latter with the fourth guide groove.

4. The locking device of claim 1, further characterized by:

(1) a shaft which is coaxial with said shaft portion of the latch hook body and constrained to rotate therewith and which projects a substantial distance beyond said housing in one direction; and (2) a second hook on said shaft, projecting laterally therefrom substantially parallel to said latch hook and spaced along said shaft from said housing, said second hook being constrained by said shaft to swing in unison with said latch hook, for engagement with and disengagement from a second keeper on said frame.

* * * * *